US006141804A

United States Patent [19]

Pinciaro

[11] Patent Number: 6,141,804

[45] Date of Patent: Nov. 7, 2000

[54] HYDROTHERAPY JET SYSTEM ADAPTED FOR QUICK CONNECTION TO AIR AND WATER PLUMBING

[76] Inventor: John Pinciaro, 83 Peckhill Rd., Woodbridge, Conn. 06525

[21] Appl. No.: 09/326,182

[22] Filed: Jun. 4, 1999

[51] Int. Cl.[7] ..... A61H 33/04

[52] U.S. Cl. ..... 4/541.6

[58] Field of Search ..... 4/541.1–541.6

[56] References Cited

U.S. PATENT DOCUMENTS

| | | | |
|---|---|---|---|
| 3,271,790 | 9/1966 | Schneider et al. | 4/180 |
| 4,240,166 | 12/1980 | Altman et al. | 4/542 |
| 4,317,471 | 3/1982 | King, Sr. | 137/798 |
| 4,581,781 | 4/1986 | Ebert | 4/542 |
| 4,717,078 | 1/1988 | Arp | 239/550 |
| 5,271,561 | 12/1993 | Tobias et al. | 4/541.6 |
| 5,324,081 | 6/1994 | Umezawa | 285/86 |
| 5,495,627 | 3/1996 | Leaverton et al. | 4/541.6 |
| 5,536,047 | 7/1996 | Detable et al. | 285/39 |
| 5,607,192 | 3/1997 | Lee | 285/305 |
| 5,848,444 | 12/1998 | Christopherson | 4/541.6 |
| 5,850,640 | 12/1998 | Pinciaro | 4/541.6 |
| 5,862,543 | 1/1999 | Reynoso et al. | 4/541.6 |

*Primary Examiner*—Charles E. Phillips

*Attorney, Agent, or Firm*—David P. Gordon; David S. Jacobson; Thomas A. Gallagher

[57] ABSTRACT

A hydrotherapy jet system is provided which generally includes a fixture body, a nozzle, and a fluid line connector. The fixture body is insertable into a hole in a spa tub wall. The nozzle is inserted into a front end of the fixture body. An optional cover may be provided over the front end of the fixture body securing the nozzle in position. The fluid line connector has a first end adapted to be snap fit to a rear portion of the fixture body such that a fluid-tight coupling is provided, and a second end adapted for secure coupling to a flexible plumbing conduit. The fluid line connector is couplable to the fixture body without tools by simply snap-fitting the fluid line connector with the fixture body. An O-ring is preferably provided to one of the rear portion of the fixture body and fluid line connector to ensure the fluid-tight seal. It will be appreciated that after securely coupling the fluid line connector to the fixture body, the fluid line connector is rotatable relative to the fixture body.

16 Claims, 4 Drawing Sheets

HYDROTHERAPY JET SYSTEM ADAPTED FOR QUICK CONNECTION TO AIR AND WATER PLUMBING

BACKGROUND OF THE INVENTION

1. Field of the Invention

This invention relates broadly to hydrotherapy spas, tubs and pools. More particularly, this invention relates to hydrotherapy spa jet systems adapted to be easily and quickly installed in a tub or pool.

2. State of the Art

Hot tubs and spas are generally relatively deep tubs formed by rotational molding, blow-molding or vacuum-forming. The tubs are provided with a number of fixtures including water jet assemblies. The appeal of hot tubs and spas is primarily due to the hydrotherapy provided by pressurized water jet assemblies recessed into the tub wall which provide a massaging action.

In particular, each hydrotherapy jet assembly is connected via flexible conduits to water and air manifolds which supply pressurized water and air to each jet assembly of the spa tub. The pressurized water flows through a hydrotherapy jet assembly having an expanded throat, i.e., a venturi. As the water flows through the expanded throat, the water at the center of the throat moves more rapidly than the water along the sides of the nozzle. As a result, a low pressure area is created at the center of the throat. Air is drawn from an inlet into the low pressure area and mixes with the water. The mixture of pressurized water and air thereby provide an aerated therapeutic jet of water.

Hydrotherapy jet fixtures are generally installed in a hole in the tub wall, with the fixture outlet directed into the interior of the tub. The rear of the fixture includes an air inlet and a water inlet connected to plumbing which separately provides air and water supplies. The connections of the jet fixture to the plumbing is typically a serpentine collection of flexible conduits which each must be coupled between a manifold and the respective jet fixtures at the time of spa plumbing installation. The current method of installation is undesirable for several reasons. First, all connections between plumbing fixtures (air manifold, water manifold, and spa jet fixtures) are made at the time of installation. This requires a large number of connections to be made at the installation site in typically cramped working conditions. Moreover, it may be difficult to reach and accomplish the connection due to the location of a particular jet fixture. Second, each plumbing connection (at manifold side and water and air inlets) must be glued or clamped in position by a skilled worker. If the connection is glued, several steps must be performed: opening the glue container, using an applicator to remove glue from the container, applying the glue to the outside of an end of a conduit, closing the glue container, inserting the end of the conduit into a respective slip fitting in a plumbing fixture, and holding the conduit relative to the plumbing fixture until the glue sets to secure the connection. This process must be repeated for each glued connection and can be time consuming and exhausting, particularly at hard-to-reach connections. Also, gluing requires good ventilation and a respirator should be used to avoid inhaling the glue fumes. If the connection is clamped, special tools are required and it may be difficult to utilize the tools for tightening the clamp about the conduit in the space available. Third, with respect to both gluing and clamping, the conduit and plumbing fixture are rotatably fixed after coupling. Therefore, if it is afterward desirable to direct the conduit at a different angle from the plumbing fixture, e.g., due to apparent stress being provided to the conduit, it is not possible to redirect the conduit to remove the stress without disassembling the connection and adding additional plumbing fittings, e.g., 45° or 90° elbows, or a combination thereof, to direct the conduit toward the desired location.

SUMMARY OF THE INVENTION

It is therefore an object of the invention to provide a hydrotherapy jet system having a hydrotherapy fixture which can be quickly and easily connected to air and water plumbing.

It is another object of the invention to provide a hydrotherapy jet system which permits a complete pre-assembly of the plumbing conduits for facilitated connection of the manifold to the respective jet fixtures.

It is a further object of the invention to provide a hydrotherapy jet system which requires no tools for installation in the factory or at the job site.

It is also an object of the invention to provide a hydrotherapy jet system which permits radial adjustment of a conduit relative to an inlet on the spa fixture.

In accord with these objects which will be discussed in detail below, a hydrotherapy jet system is provided which generally includes a fixture body, a jet nozzle, and a fluid line connector. The fixture body includes a front portion and a rear portion, and is insertable into a hole in a spa tub wall. The jet nozzle is inserted into a front end of the fixture body. An optional cover may be provided over the front end of the fixture body securing the nozzle in position. The fluid line connector has a first portion adapted to be snap fit to a rear portion of the fixture body such that a fluid-tight coupling is provided, and a second portion adapted for secure coupling to a flexible plumbing conduit. The fluid line connector is couplable to the fixture body without tools by simply snap-fitting the first portion of the fluid line connector with the fixture body. An O-ring is preferably provided to either the rear portion of the fixture body or the fluid line connector to ensure the fluid-tight seal. It will be appreciated that after securely coupling the fluid line connector to the fixture body, the fluid line connector is rotatable relative to the fixture body.

According to a first preferred embodiment, the hydrotherapy jet system further includes a grommet which is insertable in the hole in the tub wall and which is adapted to snugly receive the fixture body. The fixture body has a lip at a front side which prevents the fixture body from passing completely through the grommet. In addition, the fluid line connector is preferably an assembly of two discrete connectors: a water line connector and an air line connector. The water line connector is couplable to the rear side of the fixture body and provides a first pathway therethrough to the fixture body. The air line connector is couplable to the water line connector utilizing a similar coupling and provides a discrete second pathway therethrough to the fixture body. In that way, both the water line connector and the air line connector are fluid-tight in the coupling to the fixture body, yet relatively rotatable post-installation.

With this design, the ease and expediency with which a spa fixture body may be coupled to the appropriate plumbing at the installation site is improved. It will be appreciated that manifolds for water and air supply may be pre-assembled off-installation site, i.e., in the factory. The required number of appropriate diameter and length flexible conduits for the installation plumbing connections are assembled. The flexible conduits for the water manifold are secured to the second ends (those adapted for secure coupling to a flexible plumbing conduit) of water line connectors. Likewise, the flexible conduits for the air manifold are secured to second ends of air line connectors. With this project preferably completed at the factory, the invention permits installation at the assembly site to be greatly facilitated. Each water line connector is coupled by a snap fit connection to one of the fixture bodies in the tub wall. Then, each air line connector is coupled to the fixture body, e.g., via the water line connector, in a like manner. The on-site installation process is reduced in time and simplified, and no tools are required for the plumbing connections. Due to the ease of assembly, the system can be marketed to and assembled by the do-it-yourself market.

It will be appreciated that other fixture bodies may also be provided which are adapted for coupling to a fluid line connectors. Additionally, it is not required to have the fluid line connectors include both air and water inlets. For example, according to a second embodiment, the air inlet may be integrally molded with or otherwise provided to the fixture body, while the water inlet may be provided in a water line connector as described above.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
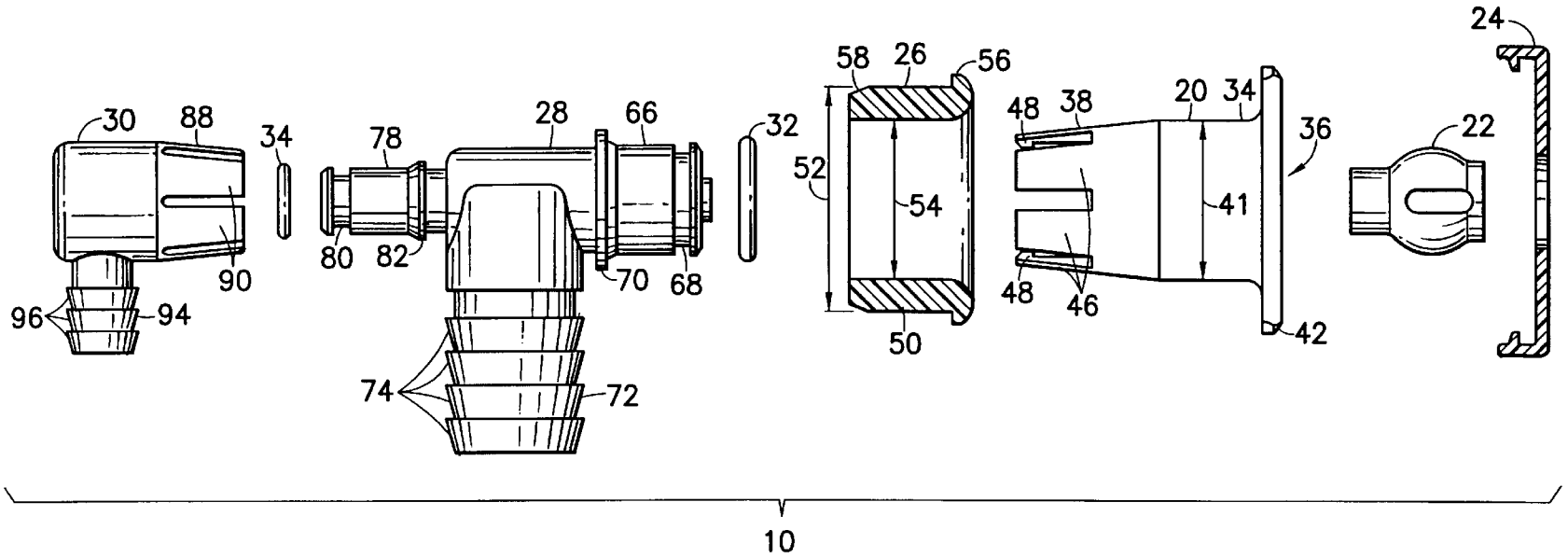
FIG. 1 is an exploded side elevation of a hydrotherapy jet system according to a first embodiment of the invention.
Figure 2:
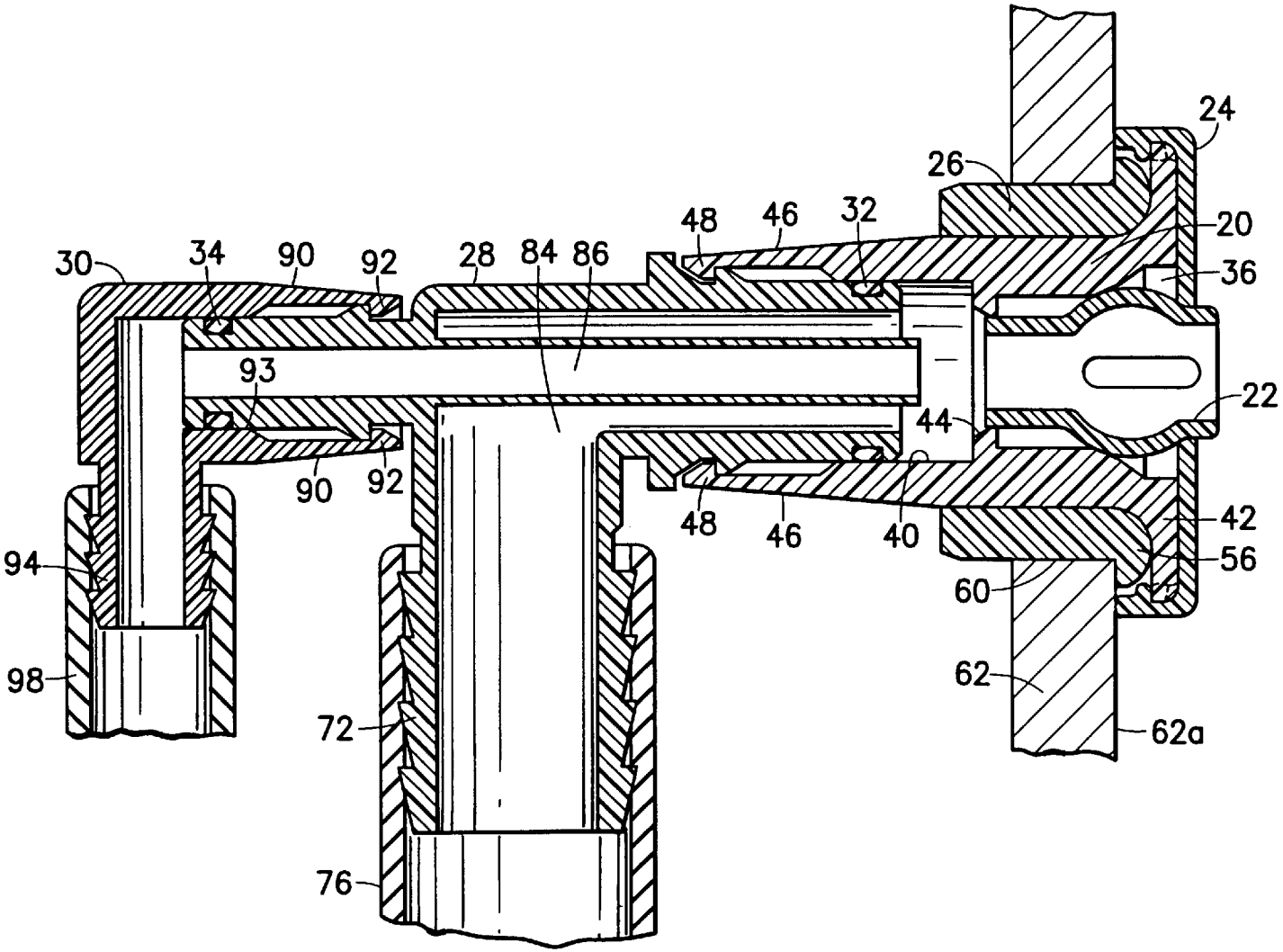
FIG. 2 is a section view of an assembled hydrotherapy jet system according to the first embodiment of the invention.

Turning now to FIGS. 1 and 2, a first preferred embodiment of a hydrotherapy jet system 10 generally includes a fixture body 20, a nozzle 22, a cover 24, a resilient grommet 26, a water line connector 28, an air line connector 30, and two O-rings 32, 34. The fixture body 20, the nozzle 22, the cover 24, the water line connector 28, and the air line connector 30 are all preferably made from schedule #40 PVC, although other materials could be utilized for one or more of these elements.

The fixture body 20 generally includes a front portion 34 with an opening 36, a preferably tapered rear portion 38, an inner surface 40, an outer diameter 41, a peripheral lip 42 at or adjacent the opening 36, and a throat 44. The rear portion 38 includes a plurality of resilient flanges 46 each having a radially inward directed barb 48. The nozzle 22 is received in the opening 36 at the front portion 34 and preferably secured therein by the cover 24.

The grommet 26 includes a body portion 50 having an outer diameter 52, an inner diameter 54, a front lip 56 and a rear bevel 58. The outer diameter 52 is sized such that the grommet 26 may be received in a hole 60 in a wall 62 of a tub. The rear bevel 58 assists the insertion of the grommet into the hole 60. The inner diameter 54 of the grommet is sized to snugly receive the fixture body 20 once the grommet is positioned within the hole in the tub. The lip 56 prevents the grommet from being dislodged from the hole in the tub when the fixture body 20 is inserted into the grommet.

The water line connector 28 of the first embodiment includes an outlet portion 66 having a peripheral groove 68 and a catch 70, a tubular water inlet portion 72 having a plurality of barbs 74 for glued or clamped connection to a flexible water conduit 76, and an air line connector male coupling portion 78 also having a peripheral groove 80 and a catch 82. The O-rings 32, 34 are provided in peripheral grooves 68 and 80. The water line connector 28 defines a water pathway 84 extending from the water inlet portion 72 to the outlet portion 66, and an air pathway 86 (preferably partially concentric with the water pathway 84) extending from the air fitting coupling portion 78 to the outlet portion 66. At the outlet portion 66 the air pathway 86 preferably extends coaxially through and beyond the water pathway 84.

The air line connector 30 of the first embodiment includes a outlet portion 88 comprising a plurality of resilient flanges 90 each have a radially inwardly directed barb 92, an inner surface 93, and a tubular air inlet portion 94 having a plurality of barbs 96 for glued or clamped connection to a flexible air conduit 98. The outlet portion 88 is sized to be engagingly received over the air line coupling portion 78.

In order to expedite on-site assembly of the hydrotherapy jet system, partial pre-assembly of the hydrotherapy system is preferred. This pre-assembly may be done off-site, i.e., at the factory, or on-site. The pre-assembly comprises obtaining water and air manifolds, and appropriate lengths of flexible conduit to extend between the installation location of the manifolds and the locations of each spa fixture body when the tub is installed. The flexible conduits for the water manifold are secured to the barbed water inlet portion 72 of respective water line connectors 28. Likewise, the flexible conduits for the air manifold are secured to the barbed air inlet portion 94 of respective air line connectors 30. The conduits are coupled to the water and air line connectors 28, 30 preferably by gluing or clamping.

Additionally, the installation of the jet fixture bodies 20 into the tub may be performed off-site or on-site. The installation includes cutting a circular hole in the tub wall and then inserting the grommet into the tub wall. The grommet is preferably pushed through the tub wall from the inside of the tub and forced therein until the lip 56 seats against the interior side 62*a* of the tub wall 62. The jet fixture body 20 is then inserted into the grommet 26 until the lip 42 of the fixture body seats substantially against the lip 56 of the grommet. Optionally, a small amount a lubricant, e.g., soapy water, is coated over the inner opening of the wall grommet to facilitate the insertion. The lubricant is chosen to be one that will not break down the material of the wall grommet or the jet fixture body. The outer diameter 41 of the jet fixture body 20 is sized relative to the inner diameter 54 of the grommet 26 such that when the fixture body is inserted into the grommet a secure fluid tight seal results.

Finally, as now described, the on-site installation is capable of being performed in a facilitated and easily expedited manner. The outlet portion 66 of the water line connector 28, with flexible water conduit 76 already attached thereto and extending to the water manifold (not shown), is pushed into the rear portion 38 of the fixture body such that the barbs 48 on the flanges 46 interlock with the catch 70 on the water line connector 28. The O-ring 32 is compressed against the interior surface 40 of the fixture body 20 and a secure fluid-tight connection is thereby provided. Additionally, it will be appreciated that the water line connector 28 is capable of being radially rotated relative to the fixture body 20 after connection therewith is secured. The outlet portion 88 of the air line connector 30, with flexible air conduit 98 already attached thereto and extending to the water manifold (not shown), is pushed over the air line connector coupling portion 78 of the water line connector such that the barbs 92 on the flanges 88 interlock with the catch 82 on the water line connector 28. The O-ring 34 is compressed against the inner surface 93 of the air line connector 28 and a secure fluid-tight connection is thereby provided. It will likewise be appreciated that the air line connector 30 is capable of being radially rotated relative to the water line connector 28 and the fixture body 20 after connection with the water line connector 28 is secured. The connection process is performed without additional tools and requires no additional securing means such as clamps or glue.

Figure 5:
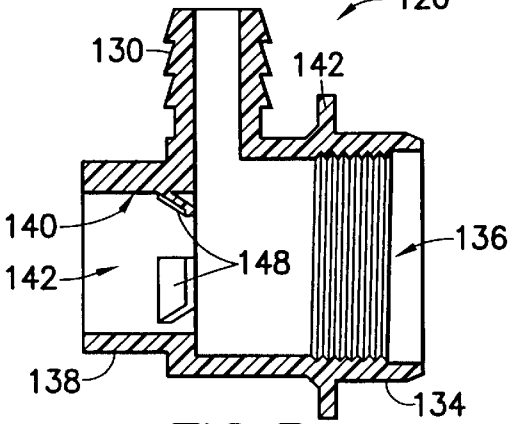
FIG. 5 is a section view of the jet fixture body of the hydrotherapy jet system according to the second embodiment of the invention.
Figure 4:
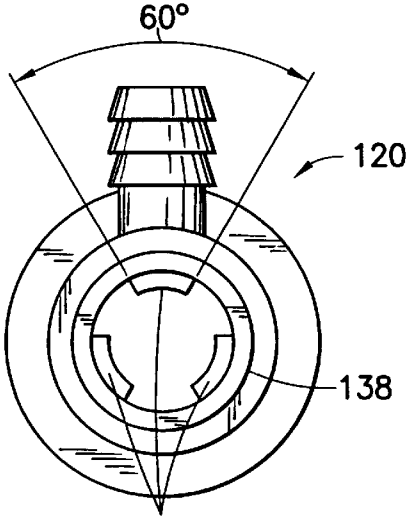
FIG. 4 is a rear end view of the jet fixture body of the hydrotherapy jet system according to the second embodiment of the invention.
Figure 3:
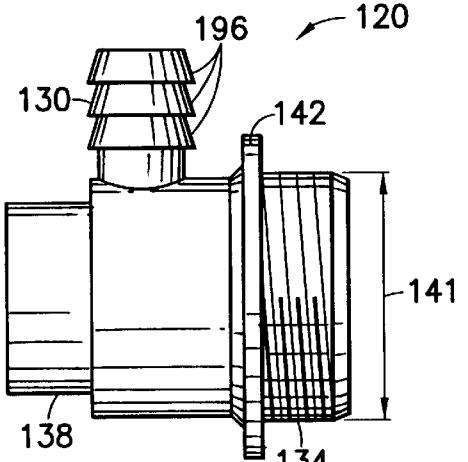
FIG. 3 is a side elevation of a jet fixture body of a hydrotherapy jet system according to a second embodiment of the invention.

Turning now to FIGS. 3 through 8, a second embodiment of a hydrotherapy jet system 110 according to the invention is shown. The system 110 includes a fixture body 120, a grommet 126, and a fluid connector 128. Referring particularly to FIGS. 3 through 5, the fixture body 120 includes a front portion 134, a rear portion 138, and an air inlet 130. The front portion 134 has an outer diameter 141 and is provided with a lip 142 recessed from a front end opening 136. The rear portion 138 has a water inlet 142 and an inner surface 140. The inner surface 140 is preferably provided with three radially spaced resilient barb-like portions 148, each preferably extending 60° about the inner circumference of the inner surface 140. The air inlet 130 is a tubular portion preferably extending radially from the fixture body and having a plurality of barbs 196 thereon for coupling a flexible air conduit thereto.

As described with respect to the first embodiment, the opening 136 at the front portion 134 of the fixture body 120 is adapted to receive a nozzle which is preferably secured therein by a cover.

Figure 7:
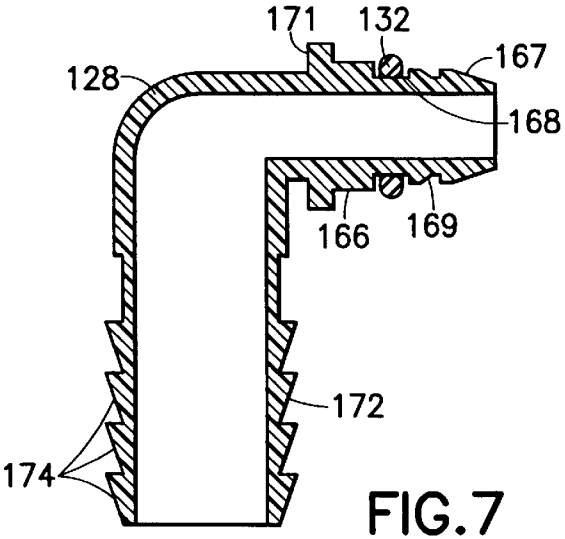
FIG. 7 is a section view of the water line connector of the hydrotherapy jet system according to the second embodiment of the invention.
Figure 6:
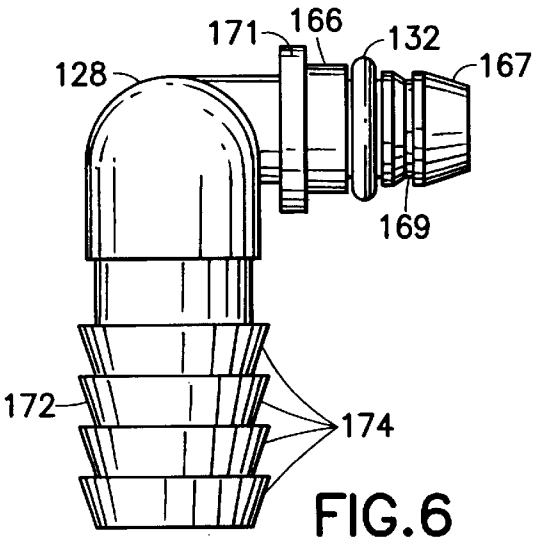
FIG. 6 is a side elevation of a water line connector of the hydrotherapy jet system according to the second embodiment of the invention.

Referring now to FIGS. 6 and 7, the fluid connector 128 is a tubular member having an inlet portion 172 and an outlet portion 166. The inlet portion 172 has a plurality of barbs 174 thereon for coupling a flexible water conduit thereto. The outlet portion 166 has a preferably tapered end 167, a circumferential groove 168, a circumferential catch 169, and optionally includes a rear lip 171. An O-ring 132 is provided in the groove 168.

Figure 8:
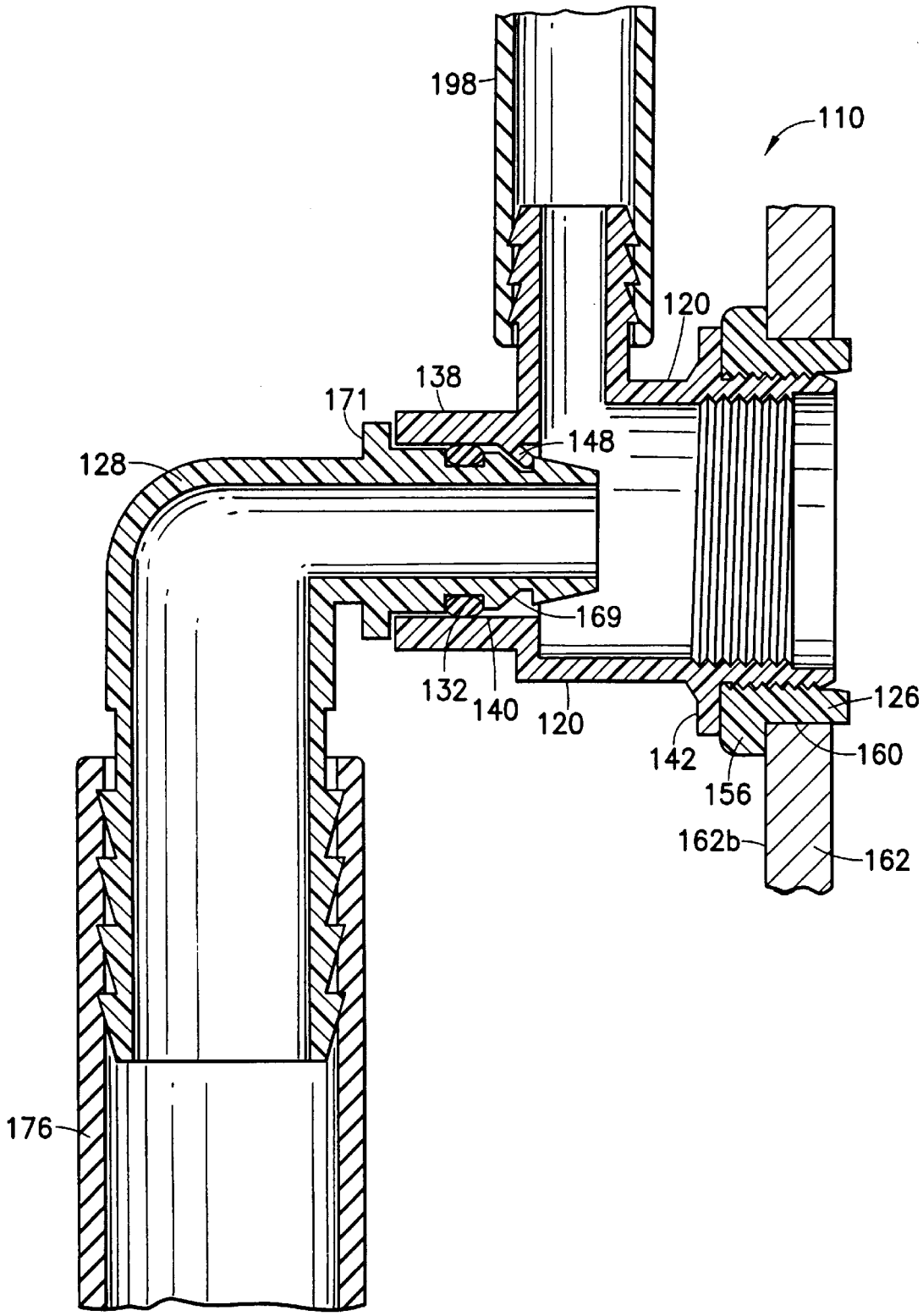
FIG. 8 is a section view of the assembled hydrotherapy jet system according to the second embodiment of the invention.

Turning now to FIG. 8, the hydrotherapy system 110 is preferably assembled as follows. The air inlet portion 130 of the fixture body 120 is securably coupled to a flexible air conduit 198 and the inlet portion 172 of the fluid connector 128 is coupled to a flexible water conduit 176. A grommet 126, substantially as described with respect to the first embodiment, is inserted into a hole 160 in a tub wall 162 such that the lip 156 of the grommet seats against the exterior surface **162*b* of the wall. The fixture body 120 is inserted into the grommet from the exterior of the tub such that the lip 142 on the fixture body seats against the lip 156 of the grommet. The fixture body 120 with air conduit 198 coupled thereto is thereby secured in the tub without requiring any tools at the time of such installation. The outlet portion 166 of the fluid connector 128 is then inserted into the water inlet 142 such that the barbs 148 of the inlet engage the catch 169 and the O-ring 132 is compressed against the inner surface 140 of the water inlet 138 to provide a fluid-tight seal between the fluid connector 128 and the fixture body 120. Preferably, the components are designed such that when they are in proper alignment for interconnection and seal, the lip 171 on the fluid connector 128 seats against the rear end of the fixture body 120**.

There have been described and illustrated herein hydrotherapy jet assembly systems and methods of installing the same. While several embodiments of the invention have been described, it is not intended that the invention be limited thereto, as it is intended that the invention be as broad in scope as the art will allow and that the specification be read likewise. Therefore, while the jet valve body has been described as being preferably made from schedule #40 PVC, it may also be made from other appropriate materials, such as polyethylene and polypropylene. In addition, while water and air connectors are described as radially extending relative to the axis of the fixture body, it will be appreciated that the water and air conduit connectors may be provided with different relative angles. Also, while in the second embodiment the air inlet has been shown integral with the fixture body, it will be appreciated that the water inlet may be integral while the air inlet is provided as a distinct connector. Furthermore, the water and air inlets do not necessarily have to be barbed, as other means for connecting the water line connector and air line connector to water and air conduits can be used, e.g., various standard plumbing connections, other friction fittings, or glued connections. Moreover, while one embodiment of the water line connector provides male coupling portions for insertion into female portions of the fixture body and air line connector, it will be appreciated that the male coupling portions may be located on the fixture body and the air line connector, and the female portions may be provided to the water line connector. Also, while particular fixture bodies have been described, it will be appreciated that the invention may be utilized with other designs of fixture bodies. For example, T-type fixture bodies which pass through water and air flow to a linear array of other bodies which are coupled together, may also be used. In addition, while the fixture body is shown as being secured in the hole in the tub wall with a grommet, it will be appreciated that other means may be used to secure the fixture body therein. For example, the fixture body may be adapted to threadably mate with a wall fitting such that the tub wall is sandwiched between the fixture body and the wall fitting. It will therefore be appreciated by those skilled in the art that yet other modifications could be made to the provided invention without deviating from its spirit and scope as so claimed.

We claim:

1. A hydrotherapy spa jet system installable in a hole in a tub wall, said spa jet system comprising:

a) a fixture body including a first portion having a first inlet opening and a second portion having an outlet opening and a first engagement means and a first fluid pathway between said first inlet opening and the outlet opening;

b) a first fluid connector including a first portion having a fluid inlet and a second portion having a fluid outlet, a second fluid pathway between said fluid inlet and said fluid outlet, and a second engagement means for engaging the first engagement means of said fixture body in a substantially fluid-tight snap fit engagement such that said first fluid pathway and said second fluid pathway are in fluid communication with each other;

d) means for securing said fixture body in the hole in the tub wall; and e) a nozzle means receivable in said outlet opening of said fixture body.

2. A hydrotherapy spa jet system according to claim 1, wherein:

said fluid connector component includes a second inlet opening and a second outlet opening.

3. A hydrotherapy spa jet system according to claim 2, wherein:

said first outlet opening and said second outlet opening-are coaxial.

4. A hydrotherapy spa jet system according to claim 1, wherein:

said first engagement means one of a barb and a catch, and said second engagement means is the other of said barb and said catch.

5. A hydrotherapy spa jet system according to claim 4, wherein:

one of said first portion of said fixture body and said second portion of said first fluid connector is provided with a plurality of a flanges.

6. A hydrotherapy spa jet system according to claim 1, wherein:

said fixture body is provided with a second fluid inlet discrete from said first inlet opening.

7. A hydrotherapy spa jet system according to claim 1, wherein:

said first fluid connector and said fixture body are adapted to rotate relative to each other when said first engagement means is engaged with said second engagement means.

8. A hydrotherapy spa jet system according to claim 1, wherein:

said first engagement means includes an O-ring.

9. A hydrotherapy spa jet system according to claim 1, further comprising:

e) a second fluid connector including a first portion having a fluid inlet, a second portion having a fluid outlet and a third engagement means, and a third fluid pathway extending between said fluid inlet and said fluid outlet, said third engagement means for engaging said second portion of said second fluid connector in a substantially fluid-tight snap fit engagement with said first fluid connector such that said third fluid pathway is in fluid communication with said first fluid pathway.

10. A hydrotherapy spa jet system according to claim 9, wherein:

said first fluid connector and said second fluid connector are adapted to rotate relative to each other when said second engagement means is engaged with said first fluid connector.

11. A hydrotherapy spa jet system according to claim 9, wherein:

said first fluid connector includes a third portion having a second fluid inlet, and said second engagement means on said second fluid connector engages said third portion of said first fluid connector.

12. A hydrotherapy spa jet system according to claim 11, wherein:

said third portion of said first fluid connector includes one of a barb and a catch, and the second engagement means includes the other of said barb and said catch.

13. A hydrotherapy spa jet system according to claim 9, wherein:

said second engagement means includes an O-ring.

14. A hydrotherapy spa jet system according to claim 1, wherein:

said means for securing said fixture body in said hole is a grommet insertable into said hole, said grommet having a lip adapted to seat against the tub wall, an outer dimension adapted to be inserted into the hole, and an interior dimension sized to snugly receive said fixture body.

15. A hydrotherapy spa jet system according to claim 14, wherein:

said fixture body includes means for preventing said fixture body from passing completely through said wall grommet.

16. A hydrotherapy spa jet system according to claim 15, wherein:

said means for preventing said fixture body from passing completely through said wall grommet is an exterior lip provided on said fixture body.

* * * * *

UNITED STATES PATENT AND TRADEMARK OFFICE

CERTIFICATE OF CORRECTION

PATENT NO. : 6,141,804
DATED : November 7, 2000
INVENTOR(S) : Pinciaro

It is certified that error appears in the above-identified patent and that said Letters Patent is hereby corrected as shown below:

Column 7,
Line 5, replace "d)" with -- c) --;
Line 7, replace "e)" with -- d) --.

Signed and Sealed this

Sixteenth Day of July, 2002

*Attest:*

*Attesting Officer*

JAMES E. ROGAN
*Director of the United States Patent and Trademark Office*